US010407813B2

(12) United States Patent
Kim

(10) Patent No.: US 10,407,813 B2
(45) Date of Patent: Sep. 10, 2019

(54) METHOD FOR PREPARING KNITTING YARN HAVING WATER REPELLENT FUNCTION

(71) Applicant: Eun Sook Kim, Namyangju-si (KR)

(72) Inventor: Eun Sook Kim, Namyangju-si (KR)

( * ) Notice: Subject to any disclaimer, the term of this patent is extended or adjusted under 35 U.S.C. 154(b) by 69 days.

(21) Appl. No.: 15/506,891

(22) PCT Filed: Aug. 20, 2015

(86) PCT No.: PCT/KR2015/008717

§ 371 (c)(1),
(2) Date: Feb. 27, 2017

(87) PCT Pub. No.: WO2016/036034

PCT Pub. Date: Mar. 10, 2016

(65) Prior Publication Data

US 2017/0275800 A1 Sep. 28, 2017

(30) Foreign Application Priority Data

Sep. 2, 2014 (KR) ..... 10-2014-0116335

(51) Int. Cl.

| | |
|---|---|
| ***D06B 21/00*** | (2006.01) |
| ***D06M 15/277*** | (2006.01) |
| ***D06B 3/10*** | (2006.01) |
| ***D04B 1/14*** | (2006.01) |
| ***D06B 3/08*** | (2006.01) |

(Continued)

(52) U.S. Cl.

CPC ..... *D06B 21/00* (2013.01); *D02G 3/04* (2013.01); *D04B 1/14* (2013.01); *D06B 3/08* (2013.01); *D06B 3/10* (2013.01); *D06B 5/20* (2013.01); *D06M 15/277* (2013.01); *D06M 23/06* (2013.01); *D06L 1/18* (2013.01); *D06M 2101/12* (2013.01); *D06M 2101/26* (2013.01);

(Continued)

(58) Field of Classification Search

None

See application file for complete search history.

(56) References Cited

U.S. PATENT DOCUMENTS

| | | | | |
|---|---|---|---|---|
| 3,574,791 A * | 4/1971 | Sherman et al. | ..... | C08F 293/00 525/276 |
| 5,759,431 A * | 6/1998 | Nguyen | ..... | C08G 18/10 252/8.62 |
| 2015/0068000 A1* | 3/2015 | Asano | ..... | D04B 1/04 28/168 |

FOREIGN PATENT DOCUMENTS

| | | |
|---|---|---|
| CN | 101748575 A | 6/2010 |
| CN | 101864632 * | 10/2010 |

(Continued)

OTHER PUBLICATIONS

Machine translation of CN101864632 Yurong et al. (Year: 2010).*

(Continued)

*Primary Examiner* — Shawn Mckinnon

(74) *Attorney, Agent, or Firm* — Fay Sharpe LLP

(57) ABSTRACT

Disclosed is a method of preparing a knitting yarn having a water-repellent function, including providing a knitting yarn in the form of a skein or a cone, washing the provided yarn to remove impurities and oil therefrom, coating the washed yarn with a water-repellent agent by spraying a water repellent solution containing the water-repellent agent at a predetermined pressure, dehydrating and drying the coated yarn, and fixing the water-repellent agent to the yarn by applying heat to the dried yarn.

19 Claims, 2 Drawing Sheets

(51) Int. Cl.

| | |
|---|---|
| ***D06B 5/20*** | (2006.01) |
| ***D06M 23/06*** | (2006.01) |
| ***D02G 3/04*** | (2006.01) |
| *D06L 1/18* | (2006.01) |
| *D06M 101/12* | (2006.01) |
| *D06M 101/26* | (2006.01) |
| *D06M 101/34* | (2006.01) |

(52) U.S. Cl.
CPC .... *D06M 2101/34* (2013.01); *D06M 2200/12* (2013.01); *D10B 2401/021* (2013.01)

(56) References Cited

FOREIGN PATENT DOCUMENTS

| | | | |
|---|---|---|---|
| CN | 101962885 | A | 2/2011 |
| CN | 103850073 | A | 6/2014 |
| KR | 10-2006-0024139 | A | 3/2006 |
| KR | 10-2006-0082356 | A | 7/2006 |
| KR | 10-0829459 | B1 | 5/2008 |
| KR | 10-2012-0049579 | A | 5/2012 |
| KR | 10-1333452 | B1 | 11/2013 |
| KR | 101333452 | B1 | 11/2013 |

OTHER PUBLICATIONS

Machine translation of KR101333452 CHo (Year: 2013).*
International Search Report and Written Opinion for International Application No. PCT/KR2015/008717 dated Dec. 10, 2015 (with English translation).
Chinese Search Report from Chinese Application No. 201580047002.9 dated May 4, 2018.

* cited by examiner

METHOD FOR PREPARING KNITTING YARN HAVING WATER REPELLENT FUNCTION

CROSS-REFERENCE TO RELATED APPLICATION

This application is a 371 of PCT Application Serial No. PCT/KR2015/008717, filed Aug. 20, 2015, which claims the benefit of Korean Patent Application No. 10-2014-0116335, filed Sep. 2, 2014, which is hereby incorporated herein by reference in its entirety into this application.

TECHNICAL FIELD

The present invention relates to a method of preparing a knitting yarn having a water-repellent function.

BACKGROUND ART

Many kinds of natural fibers are strong and sturdy and have high durability despite repeated washing, compared to synthetic fibers. Also, natural fibers are superior in moisture absorption and warmth-retention properties to synthetic fibers, and are thus hygienic and have a good wearing sensation, and are mainly woven into fabric and widely used as textiles.

However, since natural fibers, having the above advantages, are hydrophilic and thus easily absorb water, fabrics made of natural fibers are readily wetted and may thus shrink. Accordingly, cloth made of natural fabric may shrink due to moisture in the rainy season or easily becomes wet due to rain on rainy days, undesirably deteriorating the wearing sensation.

With the goal of solving these problems, techniques for imparting water repellency to fabrics have been proposed, but include simple coating of the surface of a fabric with a water-repellent coating solution, and thus water-repellent performance may drastically deteriorate over time, which is undesirable.

In this regard, Korean Patent Application No. 10-2012-0052872 discloses a method of preparing a water-repellent fabric. However, this method is applied not to knitted fabrics but to woven fabrics composed of warps and wefts.

Compared to woven fabrics, knitted fabrics have high elasticity, warmth-retention properties and flexibility, and also fit bodies well, are easy to work, and are easy to handle due to wrinkle resistance. By virtue of these advantages, knitted fabrics have been used in socks, gloves, and sweaters for a long time, and the fields of application thereof have gradually expanded to encompass clothing.

As the demand for knitted fabrics, as well as woven fabrics, is increasing, functional knitted fabrics are receiving attention. In this regard, thorough research into knitted fabrics having a water-repellent function is ongoing.

Since knitting yarns are thick and weak compared to weaving yarns, shrinking and entangling of yarns, volume reduction of processed yarns, and changes in tactile sensation should be noted during the production and dyeing of yarns. Taking into consideration the features of knitted fabrics, the present inventors have long studied water-repellent treatment methods suitable for knitting yarns and thus have discovered a method of preparing a knitting yarn having a water-repellent function.

DISCLOSURE

Technical Problem

Therefore, the present invention has been devised to impart knitted fabrics with the water-repellent function of woven fabrics while maintaining the advantages of knitted fabrics, and is intended to provide a water-repellent treatment method for a knitting yarn, suitable for use in a skein form or a cone form, by applying a skein-dyeing process or a cone-dyeing process, which is a typical process for dyeing a knitting yarn, to a process of coating with a water-repellent agent, in order to prepare a knitting yarn having a water-repellent function.

Technical Solution

An embodiment of the present invention provides a method of preparing a knitting yarn having a water-repellent function, comprising: providing a knitting yarn in the form of a skein or a cone; washing the provided yarn to remove impurities and oil therefrom; coating the washed yarn with a water-repellent agent at a predetermined pressure; dehydrating and drying the coated yarn; and fixing the water-repellent agent to the yarn by applying heat to the dried yarn.

Advantageous Effects

According to an embodiment of the present invention, a water-repellent solution can permeate the inner structure of a knitting yarn, whereby the resulting knitted products can be made to retain a water-repellent function merely by coating the yarn with a water-repellent agent. Furthermore, water-repellent capability can be maintained for a long time even after repeated washing or dry cleaning.

BEST MODE

Figure 1:
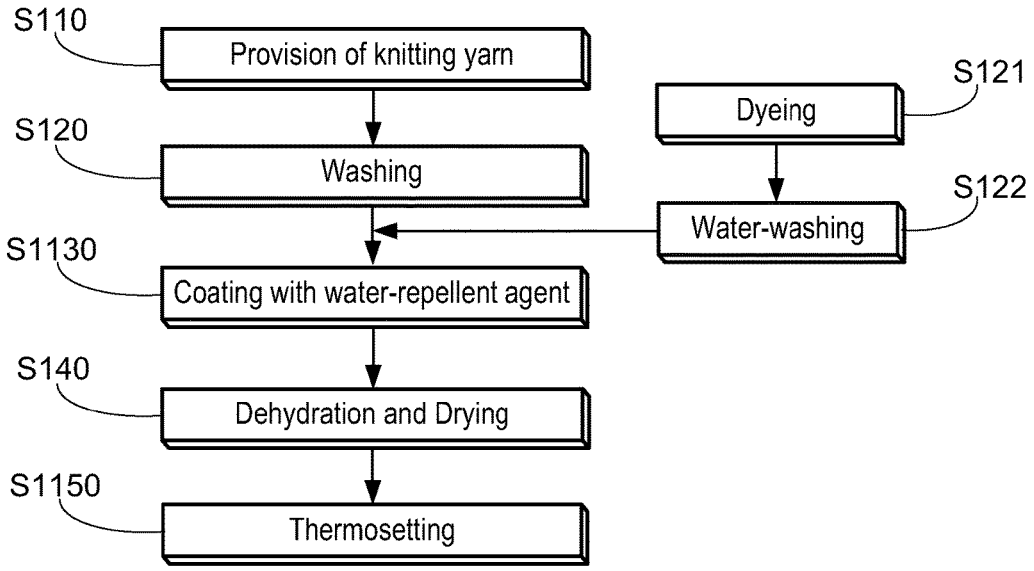
FIG. 1 is a block diagram schematically showing a yarn water-repellent treatment process according to the present invention.
Figure 2:
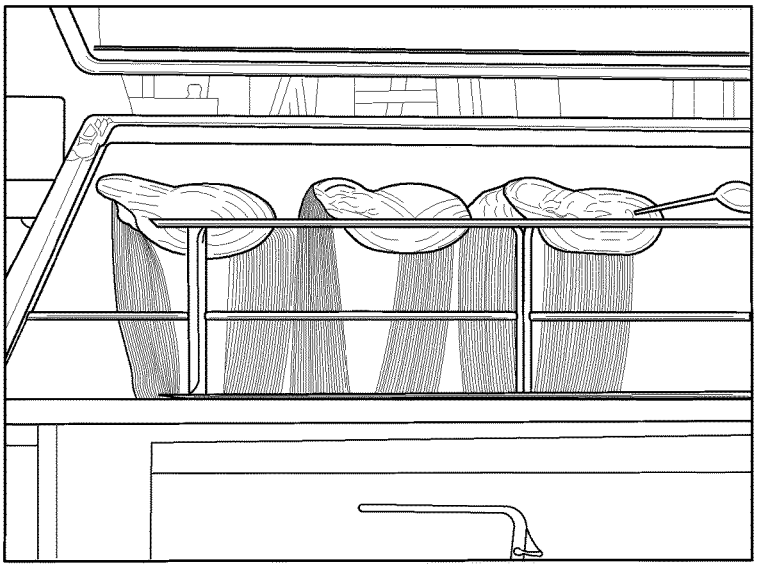
FIG. 2 is a photograph showing the knitting yarn in skein form before water-repellent treatment according to the present invention.
Figure 3:
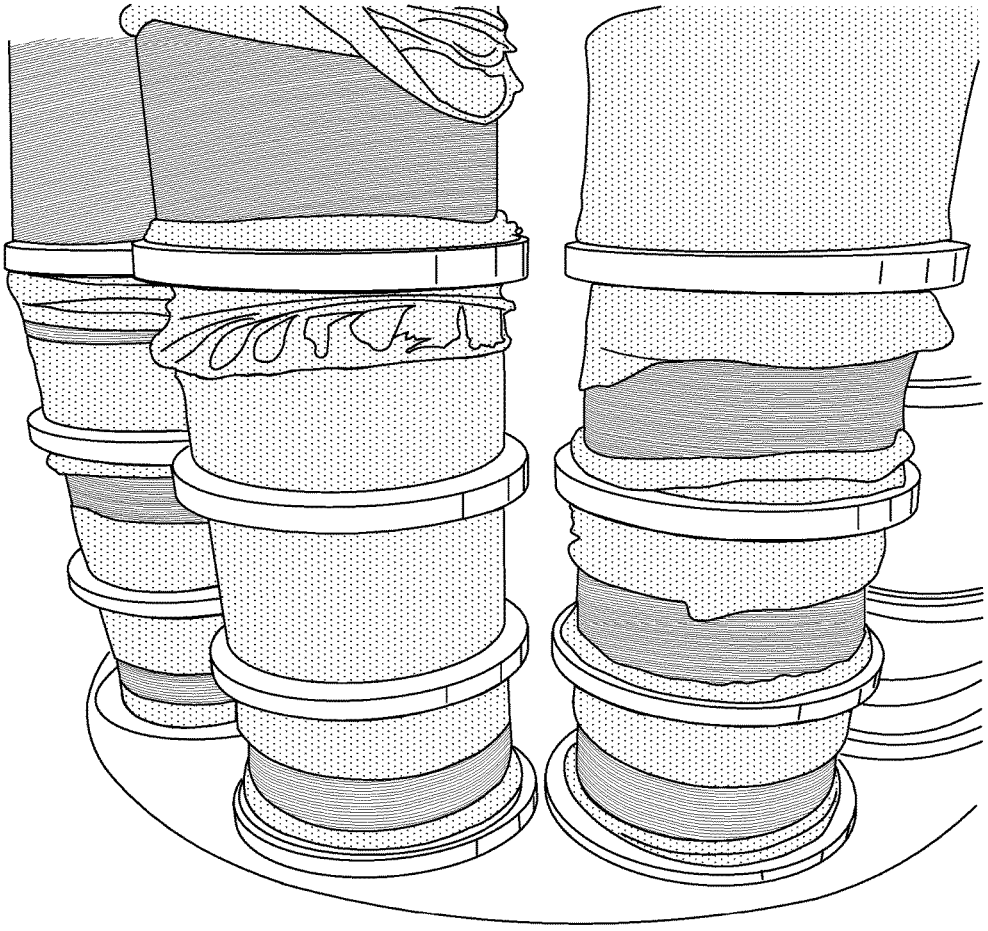
FIG. 3 is a photograph showing the knitting yarn in cone form before water-repellent treatment according to the present invention.

Exemplary embodiments of the present invention may be understood through the following description. The following description should be understood to explain specific embodiments of the present invention, and the present invention is not necessarily limited thereto. Furthermore, the appended drawings are provided for clarity, and the present invention is not limited thereto, and details of the individual components thereof may be properly understood by the specific effects of the relevant description, which will be described later.

Hereinafter, a detailed description will be given of a water-repellent treatment method for a knitting yarn according to the present invention.

In the water-repellent treatment method for a knitting yarn according to an embodiment of the present invention, the knitting yarn is provided in the form of a skein or a cone, and the pressure, temperature, and amount of water-repellent solution that is added are adjusted depending on the type of yarn, whereby a water-repellent treatment method suitable for use in a knitting yarn is implemented, unlike conventional water-repellent treatment methods.

In the water-repellent treatment method for a knitting yarn according to the present invention, the knitting yarn is washed before water-repellent treatment, and then a water-repellent solution is sprayed onto the washed knitting yarn at a predetermined pressure to realize water-repellent treatment.

Particularly, the water-repellent treatment method for a knitting yarn according to the present invention includes providing a knitting yarn in the form of a skein or a cone (S110), washing the provided yarn to remove impurities and oil therefrom (S120), coating the washed yarn with a water-repellent agent at a predetermined pressure (S130), dehydrating and drying the coated yarn (S140), and fixing the water-repellent agent to the yarn by applying heat to the dried yarn (S150).

Also, the method of the invention may further include dyeing the washed yarn with a dyeing solution (S121) and washing the dyed yarn with washing water (S122), after the washing the yarn.

Specifically, providing the knitting yarn (S110) is a process of placing the knitting yarn in a vessel in order to coat the knitting yarn with a water-repellent agent. Here, the knitting yarn is placed in the form of a skein or a cone in the vessel. The skein form is advantageous because the area coming into contact with the water-repellent agent is large compared to the cone form and thus coating with the water-repellent agent is possible even at a lower pressure. However, in the case where the yarn is thin or has low tension, it may be stretched tightly at a high speed and thus damaged during the winding on a spinning wheel after water-repellent treatment. Hence, a weaving yarn that is relatively thin is typically not subjected to coating with a water-repellent agent in skein form. In the case of the cone form, the knitting yarn has to be treated under different water-repellent conditions because the structure and thickness thereof are different from those of a weaving yarn. This difference in treatment conditions is described in the description of coating with the water-repellent agent (S130). The knitting yarn is composed of natural fibers or a blend of natural and synthetic fibers. Specifically, the natural fibers include plant fibers such as cotton or flax, and animal fibers such as silk or wool. The synthetic fibers include nylon, polyester, acrylic fibers, etc. The blended fibers may include a maximum of 99 wt % of natural fibers.

In an embodiment, the knitting yarn is composed of 45 to 75 wt % of acrylic fibers and 25 to 55 wt % of wool fibers. In another embodiment, the knitting yarn is composed of 60 to 90 wt % of wool fibers and 10 to 40% of nylon fibers. The knitting yarn has a composition typically useful in a knitting yarn.

As used herein, the term "yarn" indicates a knitting yarn. The thickness of the knitting yarn is represented by a constant weight system count ('S). The greater the yarn count, the thinner the yarn. In an embodiment, the knitting yarn has a thickness of 5 to 70 yarn count.

Next, the washing (S120) is performed to remove impurities from the yarn placed in the vessel by the providing the yarn.

When the yarn is provided in the vessel in this way, the washing process is carried out in a manner in which a soap solution at a temperature of 40 to 60° C. is sprayed onto the yarn for 20 to 30 min in order to remove impurities originally contained in the yarn and oil attached in the course of spinning. This washing process may affect subsequent procedures, that is, dyeing with the dyeing agent and coating with the water-repellent agent.

Furthermore, the dyeing (S121) is optionally performed to dye the yarn washed through the above washing process. This dyeing process functions to prepare a water-repellent yarn having a desired color, and may be additionally conducted before coating with the water-repellent agent, as necessary.

The dyeing process is carried out in a manner in which the washed yarn, from which impurities originally contained in the yarn and oil attached in the course of spinning are removed through the washing process, is dyed with a dyeing solution in a circulation-spraying manner for 2 to 4 hr.

After the completion of the dyeing of the yarn, the water-washing (S122) is performed for a long period of time until the dyeing solution does not flow out from the dyed yarn using the washing water.

The coating with the water-repellent agent (S130) is performed in a manner in which the water-repellent solution is sprayed onto the yarn so that the dyed yarn is subjected to water-repellent coating, after the washing process or after the dyeing and water-washing processes when the dyeing process is additionally included.

The coating with the water-repellent agent is carried out by spraying the water-repellent solution onto the yarn, subjected to the washing process or to the dyeing and water-washing processes, under a predetermined pressure.

Here, the water-repellent solution is composed of water and a water-repellent agent, and may further include a permeating agent, acetic acid, and a softening agent, depending on the situation.

The water-repellent coating of the yarn is typically conducted by spraying the water-repellent agent at a high temperature of 150° C. or more onto the yarn such that the yarn is coated therewith. However, the water-repellent agent, which exhibits a water-repellent effect at a high temperature, is unsuitable for use in a knitting yarn, unlike a weaving yarn. The knitting yarn may suffer from fabric damage upon high-temperature treatment, making it difficult to manifest a desired water-repellent effect upon water-repellent coating of the knitting yarn at a high temperature. The water-repellent agent suitable for use in a knitting yarn may include a fluorine-based water-repellent agent that shows a water-repellent effect even at a low temperature. The fluorine-based water-repellent agent may be a copolymer obtained by copolymerizing a fluorine monomer and an alkyl acrylate monomer, wherein the fluorine monomer functions to impart water-repellent performance and the alkyl acrylate functions to control the tactile sensation of fibers. In an embodiment, the fluorine-based water-repellent agent may be exemplified by a fluoroalkyl acrylate copolymer.

In an embodiment, the water-repellent solution includes, based on 100 parts by weight of the yarn, 1000 to 1200 parts by weight of water and 3 to 20 parts by weight of a water-repellent agent. The amount of the water-repellent agent is regarded as important in order to attain water-repellent performance in real-world applications, and the water-repellent agent is diluted with water and then fed into a spraying device for water-repellent treatment. In order to sufficiently spray the water-repellent solution on the yarn, water may be used in an amount about 10 to 12 times the weight of the yarn. Also in order to exhibit a sufficient water-repellent effect by the addition of the water-repellent agent, 3 to 20 parts by weight of the water-repellent agent is added to water based on 100 parts by weight of the yarn, and the amount thereof may be adjusted within the above range depending on the specific kind of yarn. If the amount of the water-repellent agent is less than 3 parts by weight, a desired water-repellent effect cannot be obtained. On the other hand, if the amount thereof exceeds 20 parts by weight, it is difficult to expect an improvement in the water-repellent effect despite the addition of a large amount of a water-repellent agent.

The composition of the water-repellent solution may vary depending on the form of knitting yarn that is provided. When the knitting yarn is provided in the form of a cone in the vessel, the water-repellent solution may further include a permeating agent and acetic acid. This is because the cone form is configured such that yarns are densely arranged compared to the skein form, making it impossible to uniformly permeate the water-repellent agent into all the yarns. When the cone form is subjected to water-repellent treatment, water-repellent yarns are already aligned in cone form and may thus be less entangled in a knitting process.

As the permeating agent, any permeating agent typically useful in the art may be used without limitation, so long as it has no influence on water-repellent performance upon water-repellent treatment and has high permeation and emulsification functions. In an embodiment, the permeating agent may be a permeating agent including a fatty amine condensate. The permeating agent has to be used after complete removal of acids, alkalis, and dyeing adjuvants used during the dyeing process. In particular, the remaining alkali and dyeing adjuvant may break the emulsification of a product, thus producing a precipitate, undesirably deteriorating the performance of the product. In order to prevent the performance of the product from deteriorating due to the above causes, acetic acid is also used. The acetic acid is added to remove the alkali remaining in the product, and functions to maintain an appropriate pH so as to suitably activate the permeating agent.

In the water-repellent treatment of the knitting yarn, the water-repellent agent, permeating agent and acetic acid are used in appropriate amounts depending on the kind of fabric and the extent of water-repellent treatment. In an embodiment, when the knitting yarn is provided in skein form in the vessel, the water-repellent solution includes, based on 100 parts by weight of the yarn, 1000 to 1200 parts by weight of water and 4 to 7 parts by weight of the water-repellent agent. In another embodiment, when the knitting yarn is provided in cone form in the vessel, the water-repellent solution may further include, based on 100 parts by weight of the yarn, 0.1 to 0.6 parts by weight of the permeating agent and 0.3 to 1 parts by weight of acetic acid. If the amount of the permeating agent is less than 0.1 parts by weight, the water-repellent agent cannot sufficiently permeate the yarn due to the features of the cone form. On the other hand, if the amount thereof exceeds 0.6 parts by weight, an increased permeation effect cannot be obtained despite the addition of excess permeating agent. The acetic acid is used to remove the remaining alkali from the product, and is added in an amount of less than 0.3 parts by weight. In the case where the acetic acid is added in an amount of greater than 1 part by weight, the yarn may be damaged due to the increase in the amount of acid. In an embodiment, the weight ratio of the permeating agent to the acetic acid in the water-repellent solution is 3:5. Given the above range, the permeation effect of the permeating agent may be obtained based on the test results.

In an embodiment, the water-repellent solution may include a softening agent. Here, any softening agent may be used without limitation so long as it is typically known in the art. The softening agent functions to prevent the tactile sensation of yarn from becoming stiff due to the use of the water-repellent agent. Typically, the softening agent may be used together with the water-repellent agent. However, in order to increase the water-repellent effect, preferably, water-repellent coating using the water-repellent solution should precede treatment with the softening agent. The softening agent may deteriorate a water-repellent function, and some water-repellent agents may contain a softening component, and thus, more preferably, the softening agent is not used in cases where there is no problem with the tactile sensation of the yarn.

In the water-repellent coating process, the pressure required to supply the water-repellent solution is set to the range of 0.4 $Kgf/cm^2$ to 10 $Kgf/cm^2$ to permeate the water-repellent solution into the knitting yarn within a short time so as to enable the water-repellent treatment. For example, the pressure required to supply the water-repellent solution may be about 0.4 or more, 0.5, 0.6, 0.7, 0.8, 0.9, 1, 2, 3, 4, 5, 6, 7, 8, 9, or 10 $Kgf/cm^2$, or may be any range between these numerical values. If the pressure is less than 0.4 $Kgf/cm^2$, the water-repellent solution cannot sufficiently permeate the yarn. On the other hand, if the pressure exceeds 10 $Kgf/cm^2$, the yarn may be damaged by pressure. Generally, the cone form requires higher pressure than the skein form. As mentioned above, this is because the cone form has a denser structure than the skein form, and thus the permeation of the water-repellent agent is limited.

The temperature of the water-repellent solution and the water-repellent coating time are set to the ranges of 30 to 60° C. and 15 min to 1 hr so as to permeate the water-repellent solution into the knitting yarn to thus realize the water-repellent coating. If the temperature of the water-repellent solution, suitable for the use of the water-repellent agent, is lower than 30° C., it is difficult to sufficiently coat the yarn with the water-repellent agent. On the other hand, if the temperature thereof is higher than 60° C., the yarn may be damaged. The time required to spray the water-repellent solution is the period of time for which the water-repellent agent may be sufficiently applied on the basis of the amount of the water-repellent solution.

In the dehydrating and drying processes, excess water-repellent solution is removed from the yarn subjected to the water-repellent coating process, after which a thermosetting process is conducted in a manner in which heat is applied to the dried yarn so that the water-repellent agent is fixed to the yarn. This thermosetting process is typically performed by applying heat at about 80 to 120° C. In the case of knitting yarn, heat of less than 100° C. is applied to prevent damage to the yarn.

The knitting yarn thus prepared is configured such that the yarn is coated with the water-repellent agent, thus exhibiting a water-repellent function. The amount of the water-repellent agent that is absorbed and applied on the yarn may vary depending on the amount of the water-repellent agent that is supplied and the kind of fiber. In an embodiment, the yarn may be coated with the water-repellent agent in an amount of 2 to 4 parts by weight based on 100 parts by weight of the yarn. If the amount of the water-repellent agent is less than 2 parts by weight based on 100 parts by weight of the yarn, an appropriate water-repellent function cannot be obtained. On the other hand, if the amount thereof exceeds 4 parts by weight, economic benefits regarding the amount of the water-repellent agent may be negated.

A better understanding of the present invention may be obtained through the following examples which are set forth to illustrate, but are not to be construed to limit the scope of the present invention.

EXAMPLES

Example 1

As a knitting yarn, a yarn comprising 30 wt % of wool and 70 wt % of acryl was used, and 1 kg of the knitting yarn was provided in the form of a skein in a vessel. The knitting yarn thus provided was washed through a spraying process using a soap solution at a temperature of about 50° C. for about 30 min under a pressure of about 0.5 Kgf/cm$^2$ to remove impurities therefrom. Thereafter, the washed yarn was coated with a water-repellent agent by spraying a water-repellent solution at a temperature of about 40° C. and a pressure of about 0.5 Kgf/cm$^2$ for about 30 min. The water-repellent solution was composed of 10 kg of water and 60 g of a water-repellent agent, and as the water-repellent agent, JC-9000, available from BENESCO, was used. The yarn was dewatered through dehydrating and drying, heat of about 90° C. was then applied to the dried yarn so that the water-repellent agent was fixed to the yarn, thereby preparing a knitting yarn coated with a water-repellent agent.

Example 2

A knitting yarn coated with a water-repellent agent was prepared under the same conditions as in Example 1, with the exception that 10 g of a softening agent was further fed after the supply of the water-repellent solution during the water-repellent coating of Example 1.

Example 3

A knitting yarn coated with a water-repellent agent was prepared under the same conditions as in Example 1, with the exception that 30 g of a softening agent was further fed after the supply of the water-repellent solution containing 40 g of the water-repellent agent during the water-repellent coating of Example 1.

TABLE 1

Results of water-repellent testing of knitting yarn in skein form

| | Water-repellent solution (based on 1 kg of yarn) | Yarn | Results |
|---|---|---|---|
| Example 1 | 60 g of water-repellent agent | 30 wt % of wool, 70 wt % of acryl | Suitable |
| Example 2 | 60 g of water-repellent agent, and then 10 g of softening agent | 30 wt % of wool, 70 wt % of acryl | Suitable |
| Example 3 | 40 g of water-repellent agent, and then 30 g of softening agent | 30 wt % of wool, 70 wt % of acryl | Good |

(The results are based on water-repellent performance standards set forth by the FITI Testing & Research Institute. In the results of water-repellent performance, the higher the grade, the greater the water-repellent function. "Suitable" indicates results corresponding to a grade of 4 or higher, "good" indicates results corresponding to a grade of 3, and "unsuitable" indicates results corresponding to a grade of 2 or lower.)

As mentioned above, the softening agent may be fed after the supply of the water-repellent agent. Since the softening agent may affect the water-repellent effect, the softening agent need not be used, so long as the tactile sensation of the yarn may be maintained in the absence of the softening agent.

Using the knitting yarn prepared as above and having good test results, a knitted fabric was made. Even when such a knitted fabric is subjected to dry cleaning 5 to 10 times or several washing processes, the water-repellent function can be concluded to be maintained.

Example 4

As a knitting yarn, a yarn comprising 70 wt % of wool and 30 wt % of nylon was used, and 1 kg of the knitting yarn was provided in the form of a cone in a vessel. The knitting yarn thus provided was washed through a spraying process using a soap solution at a temperature of 50° C. for 30 min under a pressure of about 0.5 Kgf/cm$^2$ to remove impurities therefrom. Thereafter, the washed yarn was coated with a water-repellent agent by spraying a water-repellent solution at a temperature of 40° C. and a pressure of about 2 Kgf/cm$^2$ for 30 min. The water-repellent solution was composed of 10 kg of water, 50 g of a water-repellent agent, 3 g of a permeating agent and 5 g of acetic acid, and as the water-repellent agent, JC-9000, available from BENESCO, was used, and as the permeating agent, JW-1000, available from BENESCO, was used. The yarn was dewatered through dehydrating and drying, and heat of 90° C. was then applied to the dried yarn so that the water-repellent agent was fixed to the yarn, thereby preparing a knitting yarn coated with a water-repellent agent.

Example 5

A knitting yarn was prepared under the same conditions as in Example 4, with the exception that a yarn comprising 80 wt % of wool and 20 wt % of nylon was used as a knitting yarn, 1 kg of the knitting yarn was provided in the form of a cone in a vessel, and the water-repellent solution, composed of 10 kg of water, 50 g of a water-repellent agent, 1.25 g of a permeating agent and 0.31 g of acetic acid, was used.

TABLE 2

Results of water-repellent testing of knitting yarn in cone form

| | Water-repellent solution (based on 1 kg of yarn) | Yarn | Results |
|---|---|---|---|
| Example 4 | 50 g of water-repellent agent, 3 g of permeating agent, 5 g of acetic acid | 70 wt % of wool, 30 wt % of nylon | Suitable |
| Example 5 | 50 g of water-repellent agent, 1.25 g of permeating agent, 0.31 g of acetic acid | 80 wt % of wool, 20 wt % of nylon | Good |

(The results are based on water-repellent performance standards set forth by the FITI Testing & Research Institute. In the results of water-repellent performance, the higher the grade, the greater the water-repellent function. "Suitable" indicates results corresponding to a grade of 4 or higher, "good" indicates results corresponding to a grade of 3, and "unsuitable" indicates results corresponding to a grade of 2 or lower.)

The above yarn was selectively used for the testing of the present invention, and the above test results were not limited only to the above yarn. Through the aforementioned examples, appropriate amounts of the water-repellent agent, permeating agent, and acetic acid for the water-repellent solution were determined. Furthermore, acetic acid was used to activate the permeating agent, and the supply ratio of the permeating agent to the acetic acid was determined.

Using the knitting yarn, prepared as above and having good test results, a knitted fabric was made. Such a knitted fabric can be concluded to maintain a water-repellent function even after dry cleaning 5 to 10 times or several washing processes.

The invention claimed is:

1. A method of preparing a knitting yarn having a water-repellent function, comprising;

providing a knitting yarn in a skein form or a cone form;

washing the provided yarn to remove impurities and oil therefrom;

coating the washed yarn with a water-repellent agent by spraying a water-repellent solution containing the water-repellent agent at a predetermined pressure;

dehydrating and drying the coated yarn; and fixing the water-repellent agent to the yarn by applying heat to the dried yarn;

wherein the water-repellent solution comprises, based on 100 parts by weight of the yarn, 1000 to 1200 parts by weight of water and 3 to 20 parts by weight of the water-repellent agent, and wherein the heat is applied at a temperature about 80° C. to about 100° C.

2. The method of claim 1, further comprising dyeing the washed yarn with a dyeing solution and then washing the dyed yarn with washing water, after the washing the provided yarn.

3. The method of claim 1, wherein the knitting yarn comprises 45 to 75 wt % of an acryl fiber and 25 to 55 wt % of a wool fiber, or 60 to 90 wt % of a wool fiber and 10 to 40% of a nylon fiber.

4. The method of claim 1, wherein when the knitting yarn is provided in the skein form, the water-repellent solution comprises, based on 100 parts by weight of the yarn, 1000 to 1200 parts by weight of water and 4 to 7 parts by weight of the water-repellent agent.

5. The method of claim 4, wherein when the knitting yarn is provided in the cone form, the water-repellent solution further comprises, based on 100 parts by weight of the yarn, 0.1 to 0.6 parts by weight of a permeating agent and 0.3 to 1 parts by weight of acetic acid.

6. The method of claim 1, wherein the pressure ranges from 0.4 $Kgf/cm^2$ to 10 $Kgf/cm^2$.

7. The method of claim 1, wherein the knitting yarn having a water-repellent function is coated with 2 to 4 parts by weight of the water-repellent agent based on 100 parts by weight of the yarn.

8. The method of claim 2, wherein the knitting yarn comprises 45 to 75 wt % of an acryl fiber and 25 to 55 wt % of a wool fiber, or 60 to 90 wt % of a wool fiber and 10 to 40% of a nylon fiber.

9. The method of claim 2, wherein the water-repellent solution comprises, based on 100 parts by weight of the yarn, 1000 to 1200 parts by weight of water and 3 to 20 parts by weight of the water-repellent agent.

10. The method of claim 2, wherein when the knitting yarn is provided in the skein form, the water-repellent solution comprises, based on 100 parts by weight of the yarn, 1000 to 1200 parts by weight of water and 4 to 7 parts by weight of the water-repellent agent.

11. The method of claim 2, wherein the pressure ranges from 0.4 $Kgf/cm^2$ to 10 $Kgf/cm^2$.

12. The method of claim 2, wherein the knitting yarn having a water-repellent function is coated with 2 to 4 parts by weight of water-repellent agent based on 100 parts by weight of the yarn.

13. The method of claim 1, wherein the water-repellent agent is a fluorine-based water-repellent agent.

14. The method of claim 1, wherein the water-repellent agent is a copolymer obtained by copolymerizing a fluorine monomer and an alkyl acrylate monomer.

15. The method of claim 1, wherein the water-repellent agent is a fluoroalkyl acrylate copolymer.

16. The method of claim 1, wherein the knitting yarn has a thickness of 5 to 70 yarn count.

17. The method of claim 1, wherein the heat is applied at a temperature of less than 100° C. and greater than or equal to 80° C.

18. The method of claim 1, wherein the heat is applied at a temperature of about 80° C. to about 90° C.

19. The method of claim 1, wherein the knitting yard comprises a blend of natural and synthetic fibers.

* * * * *